US005559485A

United States Patent [19]

Matsuo et al.

[11] Patent Number: 5,559,485

[45] Date of Patent: Sep. 24, 1996

[54] DIELECTRIC RESONATOR

[75] Inventors: Michiaki Matsuo, Kawasaki; Morikazu Sagawa, Tokyo; Mitsuo Makimoto, Yokohama, all of Japan

[73] Assignee: Matsushita Electric Industrial Co., Ltd., Osaka, Japan

[21] Appl. No.: 360,875

[22] Filed: Dec. 21, 1994

[30] Foreign Application Priority Data

Dec. 24, 1993 [JP] Japan ..... 5-328245

[51] Int. Cl.[6] ..... H01P 7/04; H01P 7/10

[52] U.S. Cl. ..... 333/222; 333/230

[58] Field of Search ..... 333/204, 219, 333/219.1, 222, 202 DB, 230

[56] References Cited

U.S. PATENT DOCUMENTS

| | | | |
|---|---|---|---|
| 3,634,789 | 1/1972 | Stucket | 333/238 X |
| 4,506,241 | 3/1985 | Makimoto et al. | 333/222 |
| 4,837,534 | 6/1989 | Van Horn | 333/207 |
| 5,160,904 | 11/1992 | Babbitt et al. | 333/246 X |
| 5,162,761 | 11/1992 | Kita et al. | 333/219 |

FOREIGN PATENT DOCUMENTS

| | | | |
|---|---|---|---|
| 55702 | 4/1985 | Japan | 333/202 DB |
| 85403 | 3/1989 | Japan | 333/202 DB |

*Primary Examiner*—Paul Gensler
*Attorney, Agent, or Firm*—Lowe, Price, LeBlanc & Becker

[57] ABSTRACT

A dielectric resonator is provided which includes a dielectric block, an inner conductor formed on an outer surface of the dielectric block, and another outer conductor formed on an outer surface of the dielectric block. The inner conductor is so geometrically modified as to change the characteristic impedance in a manner wherein the shape of either the inner conductor or the dielectric block is changed.

31 Claims, 8 Drawing Sheets

DIELECTRIC RESONATOR

BACKGROUND OF THE INVENTION

1. Technical Field of the Invention

The present invention relates generally to a dielectric resonator which may be employed within a higher harmonic range such as a microwave band, and more particularly to an improved structure which produces a dielectric resonator of compact size with low loss.

2. Background Art

In recent years, there is an increasing need for compact and lightweight portable terminal equipment in the field of radio communication. In particular, it is required to make resonators which will usually be bulky in radio communication devices, more compact and to enhance the performance thereof.

FIGS. 11(*a*) and 11(*b*) show a conventional dielectric coaxial resonator. FIG. 11(*a*) illustrates a vertical cross section of the coaxial resonator taken along the center line thereof. FIG. 11(*b*) is a side view.

The shown coaxial resonator generally includes a hollow dielectric substance 21, an inner conductor 22, and an outer conductor 23 to complete a quarter wave resonator structure wherein one end is open-circuited and the other end is short-circuited.

FIG. 12 shows a conventional microstrip transmission line resonator which includes a dielectric substrate 31, a microstrip transmission line 32 serving as a resonance element, and a ground conductor 33 to produce a half wave resonator structure with both ends being open-circuited.

The above prior art coaxial resonator has suffered from the drawback in that the unloaded Q as a performance index of a resonator is desirably high, but the resonator structure is bulky. Additionally, the prior art microstrip transmission line resonator also encounters the drawback in that the resonator structure may be thinned, but the loss is increased. Further, since the characteristic impedance of a transmission line is uniform and the length of the transmission line is one-quarter wavelength or half wavelength, higher harmonic resonance frequencies will be odd multiples or integral multiples of the fundamental frequency, thereby making it difficult to manufacture filters which are capable of suppressing higher harmonics.

SUMMARY OF THE INVENTION

It is therefore a principal object of the present invention to avoid the disadvantages of the prior art.

It is another object of the present invention to provide a compact dielectric resonator with low loss which is designed to suppress higher harmonics effectively.

It is a further object of the present invention to provide an improved structure of a dielectric resonator which facilitates easy coupling with external circuits.

According to one aspect of the present invention, there is provided a dielectric resonator which comprises a dielectric block having a preselected length, a groove, extending in a surface of the dielectric block along the preselected length, having different widths, an inner conductor provided on an inner surface of the groove, and an outer conductor provided on an outer surface of the dielectric block.

According to another aspect of the invention, there is provided a dielectric resonator which comprises a dielectric block having a preselected length and first and second outer surfaces, the first outer surface having different heights along the preselected length, a first conductor formed on the first outer surface of the dielectric block along the preselected length, and a second conductor provided on the second surface of the dielectric block.

According to a further aspect of the invention, there is provided a dielectric resonator which comprises a dielectric block having a preselected length, the dielectric block including first and second block portions arranged along the preselected length, the first block portion having a given height greater than that of the second block portion, a groove extending in a surface of the first block portion along the preselected length of the dielectric block to open to the second block portion, the groove having a first width, an inner conductor provided on an inner surface of the groove, and an outer conductor so provided on a surface of the second block portion of the dielectric block as to extend to the inner conductor, the outer conductor having a second width greater than the first width of the groove.

According to a still further aspect of the invention, there is provided a dielectric resonator which comprises a dielectric block having a preselected length, a groove extending in a surface of the dielectric block along the preselected length, the groove including first, second, and third groove portions, the first groove portion having a first width, the second groove portion having a second width greater than the first width, the third groove portion communicating between the first and second groove portions and being defined by tapered inner walls widening from the first groove portion to the second groove portion, an inner conductor provided on an inner surface of the groove, and an outer conductor provided on an outer surface of the dielectric block.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for the purpose of explanation and understanding only.

In the drawings:

FIG. 1(*b*) illustrates the dielectric resonator shown in FIG. 1(*a*), as viewed from the rear side;

FIG. 5(*c*) is a perspective view which shows a modification of the fifth embodiment in FIGS. 5(*a*) and 5(*b*);

FIG. 11(*b*) is a side view which illustrates the dielectric coaxial resonator shown in FIG. 11(*a*)

DESCRIPTION OF THE PREFERRED EMBODIMENT

Figure 1A:
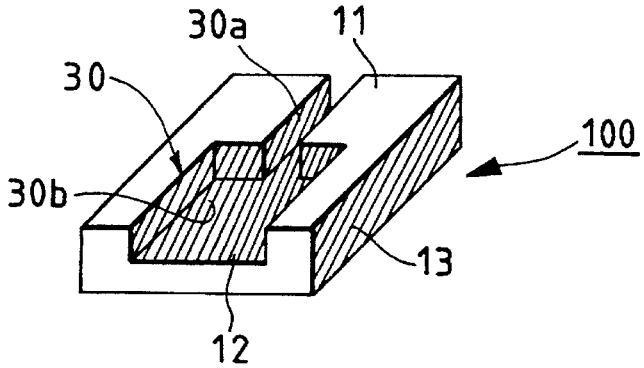
FIG. 1(*a*) is a perspective view which shows a dielectric resonator according to the present invention.
Figure 1B:
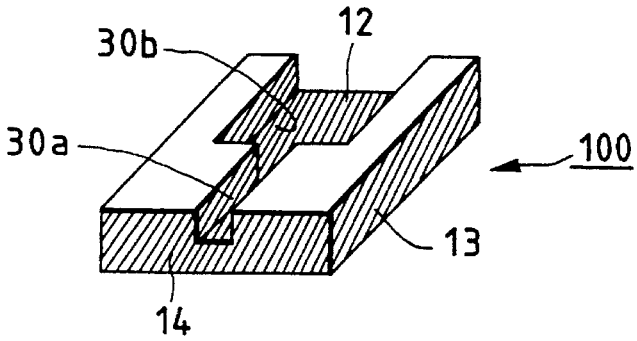

Referring now to the drawings, wherein like numbers refer to like parts in several views, particularly to FIGS. 1(*a*) and 1(*b*), there is shown a dielectric resonator 100 according to the present invention. FIG. 1(*a*) is a perspective view, and FIG. 1(*b*) illustrates the dielectric resonator 100 shown in FIG. 1(*a*), as viewed from the rear side.

The dielectric resonator 100 generally includes a rectangular parallelepiped dielectric block 11, an inner conductor 12, an outer conductor 13, and a short-circuit conductor 14. The dielectric block 11 has formed in its upper surface an open groove 30 which extends parallel to the longitudinal center line of the dielectric block 11. The groove 30, as can be seen in the drawings, includes a narrow groove 30*a* and a wide groove 30*b*. The inner conductor 12 is formed by metallizing an inner wall of the groove 30. The outer conductor 13 is formed by metallizing three of four outer surfaces of the dielectric block 11 extending parallel to the groove 30, i.e., side surfaces and a lower, or bottom surface (not shown) of the dielectric block 11. Also, the short-circuit conductor 14 is, as shown in FIG. 1(*b*), formed by metallizing one of two end surfaces of the dielectric block 11 extending perpendicular to the groove 30 to establish electric communication between the inner and outer conductors 12 and 13.

The variation in width between the inner conductor coated on the narrow groove 30*a* and the wide groove 30*b* of the groove 30 causes the characteristic impedance to be changed stepwise. The dielectric resonator 100 is a quarter wave resonator having a structure wherein one end is opened and the other is short-circuited. The provision of the short-circuit conductor 14 formed on the end of the dielectric block 11 with which the narrow groove 30*a* communicates allows the resonator 100 to have a full length along the longitudinal center line shorter than that of a typical quarter wave resonator exhibiting an uniform characteristic impedance. Additionally, the stepwise variation in characteristic impedance causes odd harmonic resonance frequencies, which would be objectionable in a typical quarter wave resonator, to be shifted from odd multiples of the fundamental frequency. Thus, when the dielectric resonator 100 is used with a filter, the higher harmonics can be suppressed effectively. Further, the inner conductor 12 formed with a metal coated on the inner wall of on the groove 30 serves to reduce the loss of the resonator.

Figure 2:
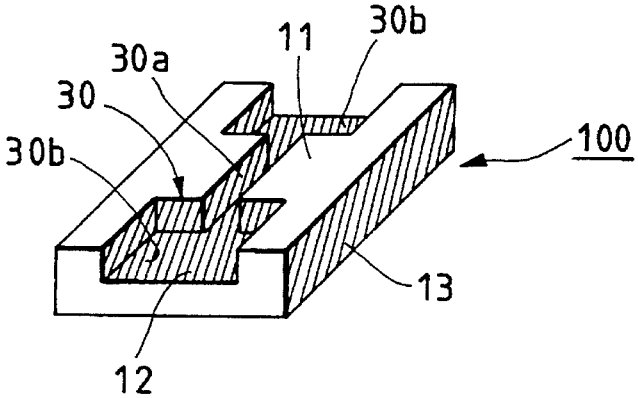
FIG. 2 is a perspective view which shows a dielectric resonator according to the second embodiment.

Referring to FIG. 2, there is shown a dielectric resonator 100 according to the second embodiment which is different from the above first embodiment in that the short-circuit conductor 14 is not provided to have both ends of the dielectric block 11 open-circuited, and the groove 30 includes two wide grooves 30*b* and one narrow groove 30*a* communicating between the wide grooves 30*b*. Other arrangements are the same and explanation thereof in detail will be omitted here.

With the dielectric resonator 100 thus constructed, the stepwise variation in characteristic impedance is, similar to the first embodiment, produced with a stepwise variation in width of the inner conductor 12 at locations of the same distance away from the lateral center line of the dielectric block 11. The dielectric resonator 100 of this embodiment is a half wave resonator having both ends open-circuited. The decreased width of the inner conductor 12 in the narrow groove 30*a* allows the resonator 100 to have a full length shorter than that of a typical quarter wave resonator exhibiting an uniform characteristic impedance. Additionally, the stepwise variation in characteristic impedance, likewise to the first embodiment, causes higher harmonic resonance frequencies to be shifted from odd multiples of the fundamental frequency. Further, the inner conductor 12 formed with a metal coated on the inner wall of on the groove 30 serves to reduce the loss of the resonator 100.

Figure 3A:
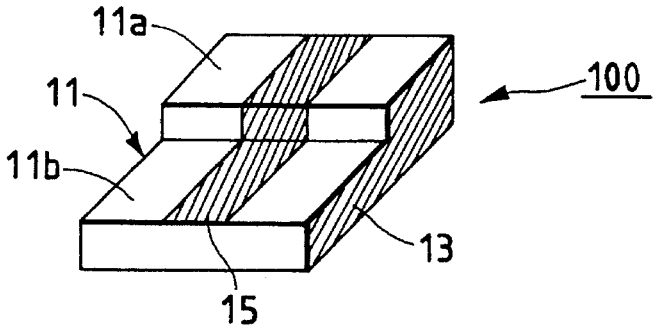
FIGS. 3(*a*) and 3(*b*) are perspective views which show a dielectric resonator according to the third embodiment.
Figure 3B:
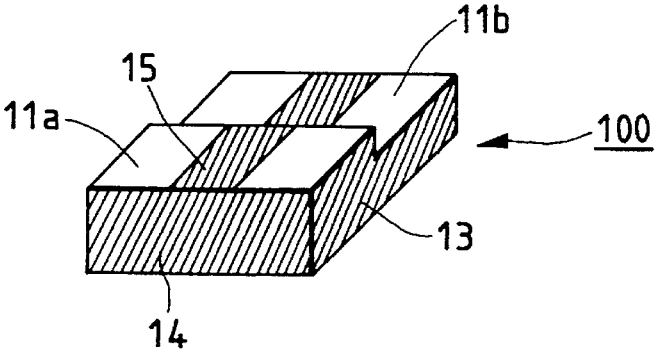

Referring to FIGS. 3(*a*) and 3(*b*), there is shown a dielectric resonator 100 according to the third embodiment of the invention.

A dielectric block 11 is stepped to form first and second portions 11*a* and 11*b*. The second portion 11*b* has the same width as that of the first portion 11*a*, but is lower in height than the first portion 11*a*. A strip-like inner conductor 15 is made of a metallic film having a constant width, and is formed along the longitudinal center line of the dielectric block 11. An outer conductor 13 is, similar to the first embodiment, provided on both side surfaces and a lower surface of the dielectric block 11. A portion of the outer conductor 13 on the lower surface of the dielectric block 11 serves as a ground conductor. A short-circuit conductor 14 is so formed on a rear end surface of the dielectric block 11 as to short-circuit the inner conductor 15 to the outer conductor 13.

With the dielectric resonator 100 thus constructed, the stepwise variation in characteristic impedance of a resonant element is established with the difference in interval from the ground conductor formed on the lower surface of the dielectric block 11 to the inner conductor 15 between the first and second portions 11*a* and 11*b*. The dielectric resonator 100 of this embodiment is a quarter wave resonator with one end being open-circuited and the other end being short-circuited, however, may be reduced in length as compared with a typical quarter wave resonator assuming an uniform characteristic impedance because the short-circuit conductor 14 is, as shown in FIG. 3(*b*), formed on the end surface of the first portion 11*a* higher than the second portion 11*b* of the dielectric block 11. Additionally, the stepwise variation in characteristic impedance produced without changing the width of the inner conductor 15 makes it possible to realize a resonator with low loss.

Figure 4:
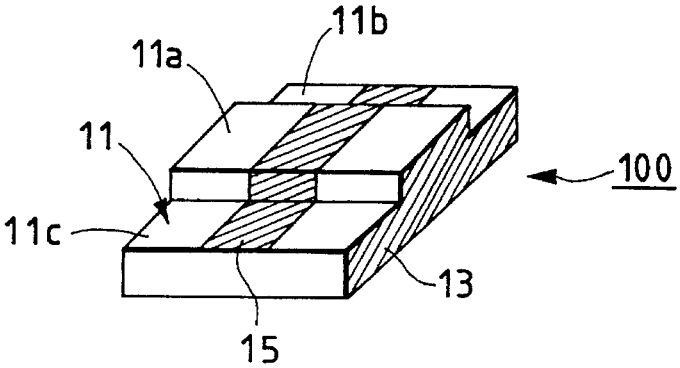
FIG. 4 is a perspective view which show a dielectric resonator according to the fourth embodiment.

FIG. 4 shows a dielectric resonator 100 according to the fourth embodiment which is a modification of the third embodiment shown in FIGS. 3(*a*) and 3(*b*).

The dielectric resonator 100 of this embodiment is, as clearly shown in the drawing, different from that of the third embodiment in that a dielectric block 11 includes first, second, and third portions 11*a*, 11*b*, and 11*c* and has its both ends open-circuited without use of the short-circuit conductor 14. The second and third portions 11*b* and 11*c* have the same length along the longitudinal center line of the dielectric block 11, and are equal in level to each other, while the first portion 11*a* is higher than the second and third portions 11*b* and 11*c*. Other arrangements are the same as those of the third embodiment and explanation thereof in detail will be omitted here.

The dielectric resonator 100 of this embodiment is a half wave resonator with both ends being open-circuited, however, may be reduced in length as compared with a typical half wave resonator designed to assume an uniform characteristic impedance since the dielectric block 11 is stepped to have the central portion higher than the end portions.

Figure 5A:
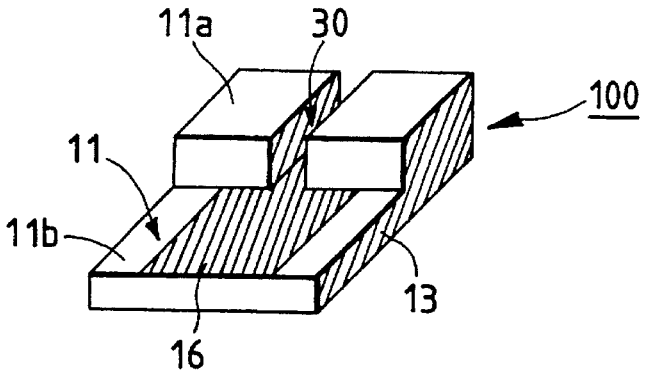
FIGS. 5(*a*) and 5(*b*) are perspective views which show a dielectric resonator according to the fifth embodiment.
Figure 5B:
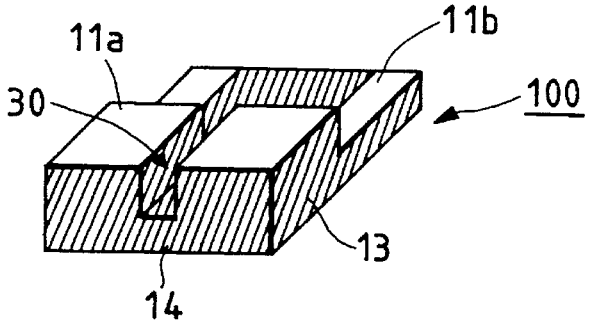
Figure 5C:
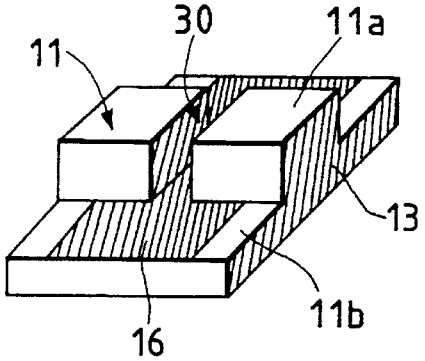

FIGS. 5(*a*) and 5(*b*) show a dielectric resonator 100 according to the fifth embodiment.

A dielectric block 11 is, similar to the third embodiment, stepped to form first and second portions 11*a* and 11*b*. The first portion 11*a* is higher than the second portion 11*b*. A groove 30 is formed in the first portion 11*a* along the longitudinal center line of the dielectric block 11. An inner conductor 16 includes two portions: one being formed with a U-shaped metallic film coated on side walls and a bottom wall of the groove 30 and the second being formed with a strip-like metal, coated on the second portion 11*b*, having a width greater than that of the groove 30. A short-circuit conductor 14 is formed on an end surface of the second portion 11*b* of the dielectric block 11.

With the dielectric resonator thus constructed, the variation in width of the inner conductor coated on the first and second portions 11*a* and 11*b* causes the characteristic impedance of a resonant element to be changed stepwise. While the dielectric resonator 100 is a quarter wave resonator having one end open-circuited and the other end short-circuited, the provision of the short-circuit conductor 14 formed on the end of the first portion 11*a* higher than the second portion 11*b* allows the resonator 100 to have a full length along the longitudinal center line shorter than that of a typical quarter wave resonator exhibiting an uniform characteristic impedance. Additionally, the stepwise change in characteristic impedance causes odd harmonic resonance frequencies to be shifted from odd multiples of the fundamental frequency. Thus, when this dielectric resonator is used with a filter, the higher harmonics can be suppressed effectively. Further, the inner conductor 16 formed on the groove 30 serves to reduce the loss of the short-circuit conductor 14 at which electric current concentrates.

Furthermore, when a plurality of the dielectric resonators 100 are arranged horizontally and oriented to the same direction, it will cause electric field coupling to be produced between open-circuited ends of the resonators for coupling the resonators with each other.

The fifth embodiment is directed to the dielectric resonator with one end being short-circuited and the other end being open-circuited, although it is in no way limited to such structure. For example, the resonator structure, as shown in FIG. 5(*c*), also offers the same advantages. This structure, as can be seen in the drawing, has a central protrusion 11*a* through which a groove 30 extends in the lengthwise direction of the resonator and both ends open-circuiting an inner conductor 16 to an outer conductor 13.

Figure 6A:
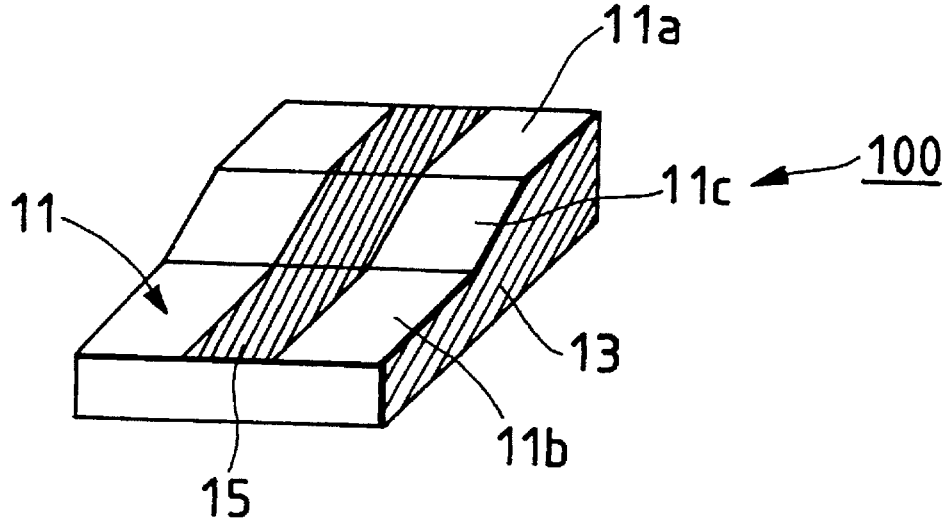
FIGS. 6(*a*) and 6(*b*) are perspective views which show a dielectric resonator according to the sixth embodiment.
Figure 6B:
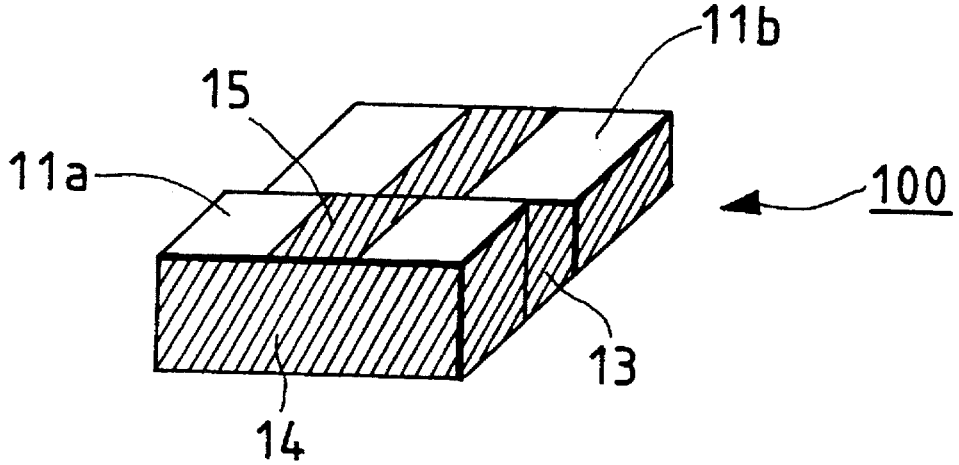

FIGS. 6(*a*) and 6(*b*) show a dielectric resonator 100 according to the sixth embodiment which is a modification of the one according to the third embodiment shown in FIGS. 3(*a*) and 3(*b*).

A dielectric block 11 includes first and second portions 11*a* and 11*b* and an intermediate portion 11*c* sloping gently from the first portion 11*a* down to the second portion 11*b*. Other arrangements are the same as those of the third embodiment and explanation thereof in detail will be omitted here.

With the dielectric resonator 100 thus constructed, the gradually sloping intermediate portion 11*c* eliminates the sharely bent corners of the inner conductor 15 formed on connections between the first portion 11*a* and the intermediate portion 11*c* and between the second portion 11*b* and the intermediate portion 11*c*, thereby avoiding wire-breakage of the inner conductor 15.

Figure 7A:
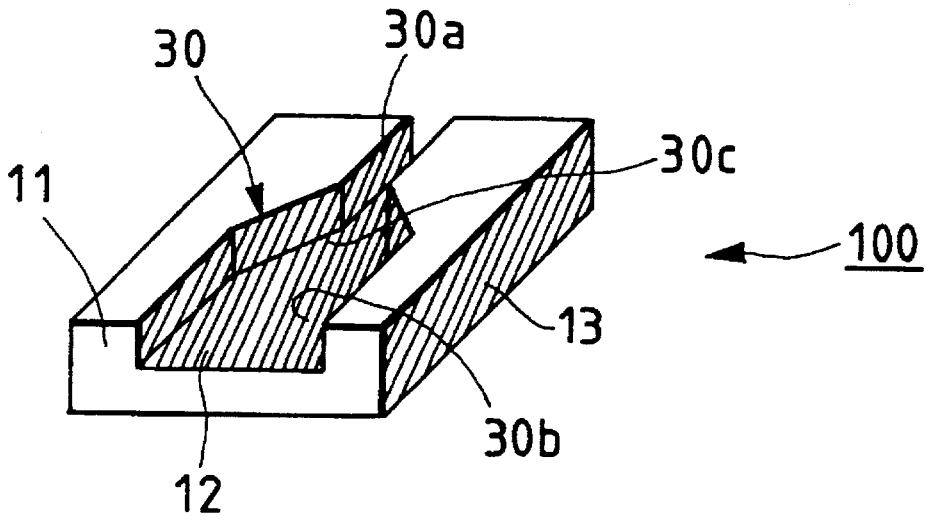
FIGS. 7(*a*) and 7(*b*) are perspective views which show a dielectric resonator according to the seventh embodiment.
Figure 7B:
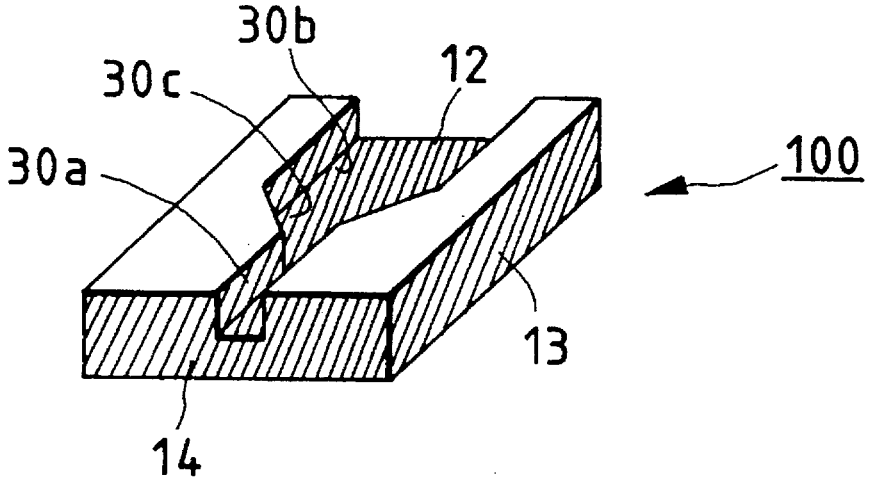

FIGS. 7(*a*) and 7(*b*) show a dielectric resonator 100 according to the seventh embodiment which is a modification of the first embodiment shown in FIGS. 1(*a*) and 1(*b*).

This embodiment is different from the first embodiment only in that a tapered intermediate groove 30*c* which is covered with the inner conductor 12, is formed between the narrow groove 30*a* and the wide groove 30*b*. As is clear from FIGS. 7(*a*) and 7(*b*), intermediate groove 30*c* has a width which varies at a predetermined rate from the width of groove 30*b* to the width of groove 30*a*. Other arrangements are the same and explanation thereof in detail will be omitted here.

With the dielectric resonator 100 thus constructed, the tapered intermediate groove 30*c* smooths connections with the narrow and wide grooves 30*a* and 30*b* for preventing wire-breakage of the inner conductor 12 from occurring.

Figure 8A:
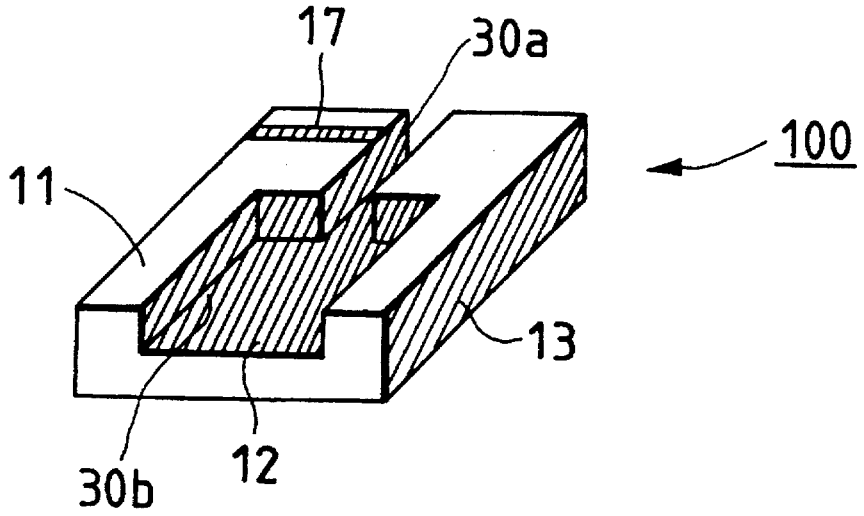
FIGS. 8(*a*) and 8(*b*) are perspective views which show a dielectric resonator according to the eighth embodiment.
Figure 8B:
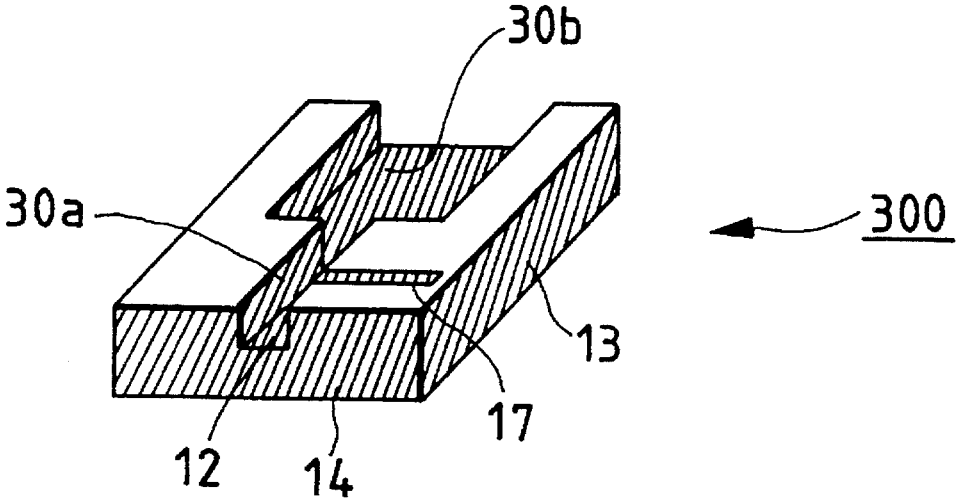

Referring to FIGS. 8(*a*) and 8(*b*), there is shown a dielectric resonator 100 according to the eighth embodiment of the invention which is a modification of the first embodiment.

This embodiment is different from the first embodiment only in that an input-output coupling line 17 is formed in an upper surface of a dielectric block 11.

The input-output coupling line 17 is, as can be seen in FIG. 8(*b*), located a predetermined distance away from the short-circuit conductor 14, and extends perpendicular to the longitudinal center line of the dielectric block 11 so as to connect with the inner conductor 12.

In operation, the input-output coupling line 17 produces a coupling circuit with an external circuit through the electric field. The adjustment of the degree of input-output coupling is accomplished by modifying an interval between the input-output coupling line 17 and the short-circuit conductor 14. An increased degree of the input-output coupling is achieved by increasing the interval between the input-output coupling line 17 and the short-circuit conductor 14, while a decreased degree of the input-output coupling is established by decreasing the interval between the input-output coupling line 17 and the short-circuit conductor 14.

This embodiment describes only the modification of the first embodiment, however, the input-output coupling line 17 may be used with any of the resonators having one end open-circuited and the other end short-circuited through the short-circuit conductor 14.

Figure 9:
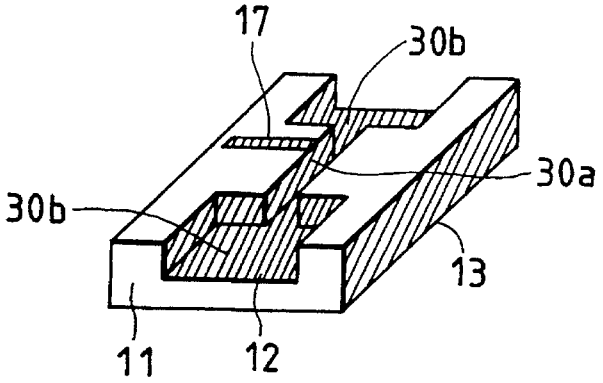
FIG. 9 is a perspective view which show a dielectric resonator according to the ninth embodiment.

FIG. 9 shows a dielectric resonator 100 according to the ninth embodiment of the invention.

This embodiment provides the resonator structure of the second embodiment with the input-output coupling line 17, as described in the above eighth embodiment.

The input-output coupling line 17 is, as can be seen in the drawing, formed on an upper surface of the dielectric block 11 between the wide grooves 30*b*, and extends perpendicular to the longitudinal center line of the dielectric block 11 to connect with the inner conductor 12.

The input-output coupling line 17, similar to the eighth embodiment, forms a coupling circuit with an external circuit through the electric field. The degree of input-output coupling with the external circuit can be adjusted by modifying an interval between the input-output coupling line 17 and the lateral center of the inner conductor 12 extending perpendicular to the longitudinal center line of the dielectric block 11. An increased degree of the input-output coupling is accomplished by increasing the interval between the input-output coupling line 17 and the lateral center of the inner conductor 12, while a decreased degree of the input-output coupling is established by decreasing the interval between the input-output coupling line 17 and the lateral center of the inner conductor 12.

Figure 10A:
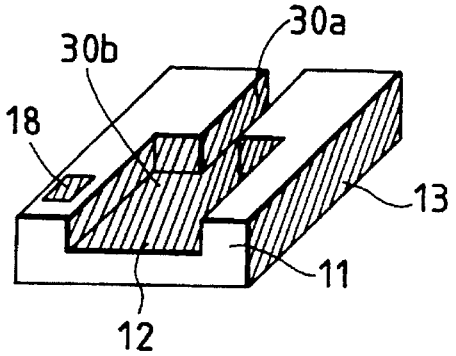
FIGS. 10(*a*) and 10(*b*) are perspective views which show a dielectric resonator according to the tenth embodiment.
Figure 10B:
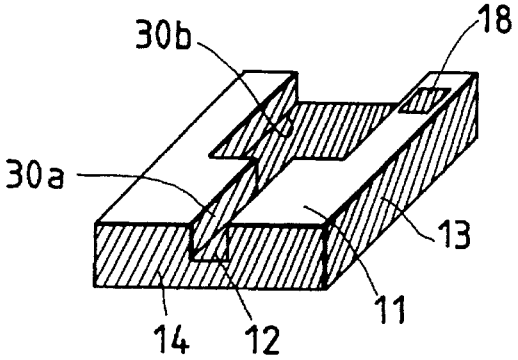
Figure 11A:
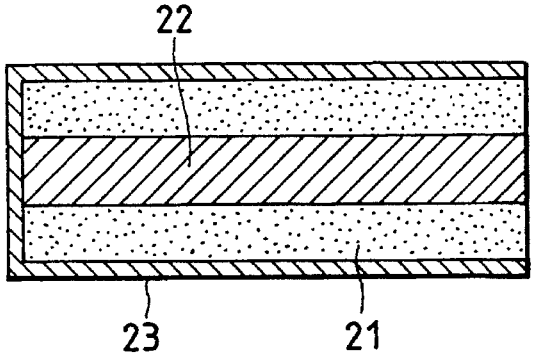
FIG. 11(a) PRIOR ART
FIG. 11(*a*) is a cross sectional view which shows a conventional dielectric coaxial resonator.
Figure 11B:
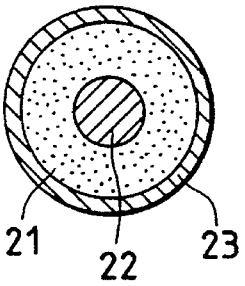
FIG. 11(b) PRIOR ART
Figure 12:
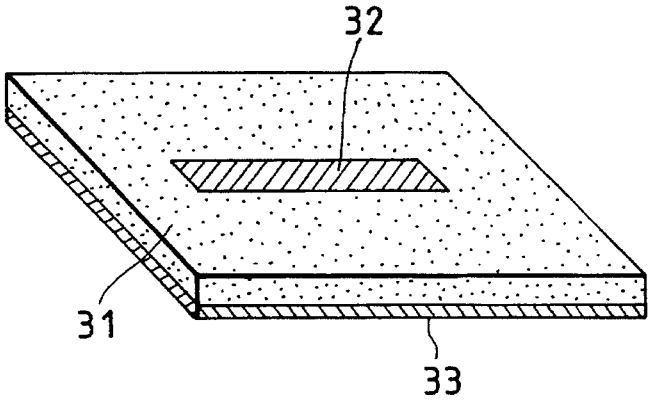
FIG. 12 PRIOR ART
FIG. 12 is a perspective view which shows a conventional microstrip transmission line resonator.

FIGS. 10(*a*) and 10(*b*) show a dielectric resonator 100 according to tenth embodiment of the invention.

This embodiment has a rectangular input-output coupling line 18 formed on the dielectric resonator 100 having the same structure as that of the first embodiment. The input-output coupling line 18 is arranged on one of side walls of the dielectric block 11 defining the wide groove 30b at a preselected interval away from an open-circuited end of the dielectric block 11, and is also out of connection with both the inner conductor 12 and the outer conductor 13.

The input-output coupling line 18, likewise to the above eighth and ninth embodiments, produces a coupling circuit with an external circuit through the electric field. The adjustment of the degree of input-output coupling is accomplished by modifying either an interval between the input-output coupling line 18 and the open-circuited end of the dielectric block 11 or an interval between the input-output coupling line 18 and the inner conductor 12. An increased degree of the input-output coupling with another dielectric resonator is achieved by decreasing the interval between the input-output coupling line 17 and the short-circuit conductor 14, while a decreased degree of the input-output coupling is established by increasing the interval between the input-output coupling line 18 and the open-circuited end of the dielectric block 11 or between the input-output coupling line 18 and the inner conductor 12.

Although this embodiment utilizes the resonator structure of the first embodiment, the input-output coupling line 18 may be used with any other resonator, as discussed above.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For example, the above first to tenth embodiment exemplify the resonator structure having the characteristic impedance increased at the short-circuited end of the dielectric block and the characteristic impedance decreased at the open end of the dielectric block for realizing a resonator of compact size, however, the characteristic impedance at the short-circuited end, although the resonator structure becomes bulky, may be decreased, while the characteristic impedance at the open-circuited end may be increased for realizing a resonator with low loss.

What is claimed is:

1. A dielectric resonator comprising:

a dielectric block having a preselected length in a predetermined direction;

a groove, extending in a surface of said dielectric block along the preselected length, said groove having a continuous center line substantially parallel to said predetermined direction and having different widths relative to said center line;

an inner conductor provided on an inner surface of said groove; and an outer conductor provided on an outer surface of said dielectric block, wherein said groove has the different widths varying in stepwise fashion.

2. A dielectric resonator comprising:

a dielectric block having a preselected length;

a groove, extending in a surface of said dielectric block along the preselected length, having different widths;

an inner conductor provided on an inner surface of said groove; and an outer conductor provided on an outer surface of said dielectric block, wherein a width of said groove varies at a predetermined rate between two of said different widths.

3. A dielectric resonator comprising:

a dielectric block having a preselected length in a predetermined direction;

a groove, extending in a surface of said dielectric block along the preselected length, said groove having a continuous center line substantially parallel to said predetermined direction and having different widths relative to said center line;

an inner conductor provided on an inner surface of said groove; and an outer conductor provided on an outer surface of said dielectric block, wherein said groove includes a wide groove and a narrow groove continuing from the wide groove.

4. A dielectric resonator as set forth in claim 3, wherein said groove extends along an entire length of said dielectric block.

5. A dielectric resonator as set forth in claim 4, wherein said dielectric block includes first and second opposing end surfaces separated from each other, and said wide groove extends through said first end surface of said dielectric block, and said narrow groove extends through said second end surface of said dielectric block.

6. A dielectric resonator comprising:

a dielectric block having a preselected length;

a groove, extending in a surface of said dielectric block along the preselected length, having different widths;

an inner conductor provided on an inner surface of said groove; and an outer conductor provided on an outer surface of said dielectric block, wherein said groove includes first, second, and third groove portions, the first and second groove portions having the same length, the third groove portion communicating between the first and second groove portions and having a preselected width different from those of the first and second groove portions.

7. A dielectric resonator as set forth in claim 6, wherein the first and second groove portions are both opened and have the same width greater than that of the third groove portion.

8. A dielectric resonator comprising:

a dielectric block having a preselected length and first, second, third, and fourth outer surfaces, the first outer surface continuing from the second outer surface through the third and fourth outer surfaces, the third outer surface being formed opposite the fourth outer surface, the first outer surface having first and second portions having different heights along the preselected length, the first and second portions both extending from the third outer surface to the fourth outer surface;

a first conductor formed on the first and second portions of the first outer surface of said dielectric block along the preselected length; and a second conductor provided on the fourth surface of said dielectric block, said dielectric block and said conductors forming a quarter wavelength resonator or a half wavelength resonator for a predetermined frequency.

9. A dielectric resonator as set forth in claim 8, wherein said first conductor has a given constant width.

10. A dielectric resonator as set forth in claim 8, wherein said dielectric block has an end surface extending perpendicular to the first and second outer surfaces, a short-circuit conductor being provided on the end surface to connect said first conductor with said second conductor.

11. A dielectric resonator as set forth in claim 10, further comprising a conductive line formed on said dielectric block and located at a preselected interval away from the short-circuit conductor.

12. A dielectric resonator as set forth in claim 8, wherein said dielectric block has first and second block portions, the first block portion having a given height greater than that of the second block portion, and having formed thereon the first portion of the first outer surface, said second block portion having formed thereon the second portion of the first outer surface, said first conductor being formed along the center line extending through the first and second block portions.

13. A dielectric resonator-as set forth in claim 8, wherein said dielectric block has end block portions and a center block portion, the center block portion having a given height greater than those of the end block portions, and having formed thereon the first portion of the first outer surface, the end block portions having formed thereon the second portion of the first outer surface, said first conductor extending on the first outer surface over the end block portions and the center block portion.

14. A dielectric resonator as set forth in claim 13, wherein the end block portions have the same length along the preselected length of said dielectric block.

15. A dielectric resonator as set forth in claim 8, wherein said dielectric block includes first, second, and third block portions, the first block portion being higher than that of the second block portion, the third block portion being arranged between the first and second block portions and sloping from the first block portion to the second block portion.

16. A dielectric resonator as set forth in claim 15, wherein said first conductor is formed along the center line extending over the first, second, and third block portions.

17. A dielectric resonator comprising:

a dielectric block having a preselected length, said dielectric block including first and second block portions arranged along the preselected length, the first block portion having a given height greater, than that of the second block portion;

a groove extending in a surface of the first block portion along the preselected length of said dielectric block to open to the second block portion, said groove having a first width;

an inner conductor provided on an inner surface of said groove; and an outer conductor so provided on a surface of the second block portion of said dielectric block as to extend to said inner conductor, said outer conductor having a second width greater than the first width of said groove.

18. A dielectric resonator as set forth in claim 17, wherein said inner and outer conductor extends along the center line of said dielectric block.

19. A dielectric resonator as set forth in claim 17, wherein said dielectric block has an end surface extending perpendicular to said groove, a short-circuit conductor being provided on the end surface to connect said inner conductor with said outer conductor.

20. A dielectric resonator as set forth in claim 19, further comprising a conductive line formed on said dielectric block and located at a preselected interval away from the short-circuit conductor.

21. A dielectric resonator as set forth in claim 17, further comprising a conductive line formed on said dielectric block connecting with the inner conductor.

22. A dielectric resonator as set forth in claim 21, wherein said conductive line is formed at a given interval away from a lateral center line of said inner conductor extending perpendicular to the preselected length of said dielectric block.

23. A dielectric resonator as set forth in claim 17, further comprising a conductive line formed on said dielectric block at a predetermined interval away from said inner conductor.

24. A dielectric resonator comprising:

a dielectric block having a preselected length;

a groove extending in a surface of said dielectric block along the preselected length, said groove including first, second, and third groove portions, the first groove portion having a first width, the second groove portion having a second width greater than the first width, the third groove portion communicating between the first and second groove portions and being defined by tapered inner walls widening from the first groove portion to the second groove portion;

an inner conductor provided on an inner surface of said groove; and an outer conductor provided on an outer surface of said dielectric block.

25. A dielectric resonator as set forth in claim 24, wherein said dielectric block has an end surface traversing the preselected length, the first groove portion opening to the end surface, a short-circuit conductor being provided on the end surface to connect said inner conductor with said outer conductor.

26. A dielectric resonator comprising:

a dielectric block having a preselected length in a predetermined direction;

a groove, extending in a surface of said dielectric block along the preselected length, said groove having a continuous center line substantially parallel to said predetermined direction and having different widths relative to said center line;

an inner conductor provided on an inner surface of said groove; and an outer conductor provided on an outer surface of said dielectric block, wherein:

said dielectric block is of a rectangular parallelopiped shape and has first, second, third, and fourth outer surfaces extending along the preselected length, said groove being formed in the first outer surface, said outer conductor being formed on the second, third, and fourth surfaces, and said dielectric block has an end surface extending perpendicular to the first, second, third, and fourth outer surfaces, a short-circuit conductor being provided on the end surface to connect said inner conductor with said outer conductor, further comprising a conductive line formed on the first outer surface located at a preselected interval away from the short-circuit conductor.

27. A dielectric resonator comprising:

a dielectric block having a preselected length;

a groove, extending in a surface of said dielectric block along the preselected length, having different widths;

an inner conductor provided on an inner surface of said groove; and an outer conductor provided on an outer surface of said dielectric block, wherein:

said dielectric block is of a rectangular parallelopiped shape and has first, second, third, and fourth outer surfaces extending along the preselected length, said groove being formed in the first outer surface, said outer conductor being formed on the second, third, and fourth surfaces, and said dielectric block has an end surface extending perpendicular to the first, second, third, and fourth outer surfaces, a short-circuit conductor being provided on the end surface to connect said inner conductor with said outer conductor, further comprising a conductive line formed on the first outer surface located at a preselected interval away from the short-circuit conductor, wherein said conductive line extends perpendicular to the center line of said dielectric block.

28. A dielectric resonator comprising:

a dielectric block having a preselected length in a predetermined direction;

a groove, extending in a surface of said dielectric block along the preselected length, said groove having a continuous center line substantially parallel to said predetermined direction and having different widths relative to said center line;

an inner conductor provided on an inner surface of said groove; and an outer conductor provided on an outer surface of said dielectric block, further comprising a conductive line formed on said dielectric block at a predetermined interval away from said inner conductor.

29. A dielectric resonator comprising:

a dielectric block having a preselected length and first, second, third, fourth, fifth, and sixth outer surfaces, the first outer surface being opposed to the second outer surface, the third outer surface being opposed to the fourth outer surface, the fifth outer surface being opposed to the sixth outer surface, the first outer surface having first and second portions along the preselected length, the first portion continuing both the third and fourth outer surfaces and the fifth outer surface, the second portion continuing both the third and fourth outer surfaces and the sixth outer surface, the entire surface of the first portion being different in height from the entire surface of the second portion;

a first conductor formed on the first and second portions of the first outer surface of said dielectric block along the preselected length; and a second conductor formed on the second outer surface of said dielectric block, said dielectric block and said conductors forming a quarter wavelength resonator or a half wavelength resonator for a predetermined frequency.

30. A dielectric resonator comprising:

a dielectric block having a preselected length and first, second, third, fourth, fifth, and sixth outer surfaces, the first outer surface being opposed to the second outer surface, the third outer surface being opposed to the fourth outer surface, the fifth outer surface being opposed to the sixth outer surface, said dielectric block including first and second end block portions and a center block portion, the center block portion having a portion of the first outer surface continuing the third and fourth outer surfaces and having a given height greater than those of the first and second end block portions, the first end block portion having a portion of the first outer surface continuing the third and fourth outer surfaces and also continuing the fifth outer surface, the second end block portion having a portion of the first outer surface continuing the third and fourth outer surfaces and also continuing the sixth outer surface;

a first conductor formed on the first outer surface of said dielectric block over the first and second end block portion and the center block portion along the preselected length; and a second conductor formed on the second outer surface of said dielectric block, said dielectric block and said conductors forming a quarter wavelength resonator or a half wavelength resonator for a predetermined frequency.

31. A dielectric resonator comprising:

a dielectric block having a preselected length and first and second surfaces, said preselected length defining a longitudinal direction corresponding thereto, a first groove in said first surface having an inner conductor therein, said inner conductor connected by a longitudinal conductive extension along the first surface to an outer conductor on the second surface of the dielectric block, said longitudinal conductive extension having a second groove therein thereby increasing an area of the conductive material therein for decreasing electrical resistance thereof said first and second grooves having a continuous center line substantially parallel to said longitudinal direction, and having different widths relative to said center line.

* * * * *